United States Patent [19]

Dewson

[11] Patent Number: 4,621,951

[45] Date of Patent: Nov. 11, 1986

[54] MODULAR REUSABLE OVERCAST

[76] Inventor: Frederick J. Dewson, 66 Koloona Avenue, Figtree, New South Wales 2525, Australia

[21] Appl. No.: 636,275

[22] Filed: Jul. 31, 1984

[30] Foreign Application Priority Data

Aug. 2, 1983 [AU] Australia ..... PG0606

[51] Int. Cl.[4] ..... E21F 1/00

[52] U.S. Cl. ..... 405/303; 405/151; 405/132; 405/288; 98/50

[58] Field of Search ..... 405/150–153, 405/288, 132, 303; 98/50

[56] References Cited

U.S. PATENT DOCUMENTS

| | | | |
|---|---|---|---|
| 1,785,096 | 12/1930 | Proctor | 405/153 |
| 2,077,137 | 4/1937 | Wilkoff | 405/151 |
| 2,077,351 | 4/1937 | Wilkoff | 405/153 |
| 2,206,825 | 7/1940 | Gillman | 405/153 |
| 2,234,782 | 3/1941 | Smith | 405/153 |
| 2,536,759 | 1/1951 | Martin et al. | 405/153 |
| 3,859,802 | 1/1975 | Platner et al. | 405/153 X |
| 4,439,064 | 3/1984 | Gaarden | 405/150 |
| 4,459,063 | 7/1984 | Shaw | 405/150 X |
| 4,464,084 | 8/1984 | Wozniak | 405/151 X |

*Primary Examiner*—Dennis L. Taylor

*Attorney, Agent, or Firm*—Cushman, Darby & Cushman

[57] ABSTRACT

The present invention relates to a modular system for construction of an overcast for use in a mine. The overcast comprises a plurality of rectangular sheets of cladding each braced to resist out of plane deformation and connected in edge abutment by fastenings extending through holes in edge flanges perpendicular to the sheets. The sheets are supported on each side of being joined to support members comprising two rectangular sheets disposed at an angle one to the other each braced to resist out of plane deformation and each having perforated edge flanges extending perpendicularly along the free edges thereof. The overcast can be extended in either length or span by the addition of further sheets and/or support members. In a modification the support members are fitted with telescopically adjustable legs which can yield in response to floor heave or roof pressure to reduce structural damage to the overcast.

8 Claims, 8 Drawing Figures

MODULAR REUSABLE OVERCAST

BACKGROUND OF THE INVENTION

1. Field of the Invention

This invention relates to a system for construction of an overcast for use in a mine. In coal mines it is usual to form a network of spaced apart passageways separated by pillars. Some of the passageways are utilized to provide ventilation to the active mining faces while others are utilized to provide a ventilation return path from the face. Cross passages communicating between the ventilation passageways are generally closed in order to improve ventilation flows.

2. Description of the Prior Art

In large passageways closing of cross passages is achieved by providing an overcast that is to say an arch like framework which permits passage through the arch and which is capable of supporting a wall or partition extending from the overcast up to the mine roof. In the past the overcast has been constructed from angle iron carried into the mine and bolted together to form the frames. A typical steel overcast required three to four hundred bolts for assembly and involves four men for four shifts for completion. The components are relatively heavy and difficult to handle in confined space within the mine.

In addition, mine passages are not of uniform dimension, nor of uniform cross-section, and in fact are liable to change in cross-section due to floor heave or roof pressure. Therefore prior overcasts built to suit the dimensions of a mine passage can be structurally deformed and/or damaged by floor heave or roof pressure.

SUMMARY OF THE INVENTION

Preferred embodiments of the present invention provide a system of prefabricated parts which may be readily transported into the mine and which permit an overcast to be constructed with a considerable reduction in labour and time requirement. One particular embodiment of the present invention provides prefabricated parts which permit an overcast to be constructed which can yield to floor heave and roof pressure.

According to one aspect the invention consists in a mine overcast construction element comprising a rectangular sheet of cladding braced to resist out of plane deformation, edge flanges extending substantially perpendicular to said sheet, and holes in said edge flanges to receive fastenings whereby one element is adapted for connection to a similar element.

According to a second aspect the invention consists in a mine overcast comprising a plurality of the above described elements connected in edge abutment by means of fastenings extending through said bolts.

According to a third aspect the invention consists in a mine overcast according to the second aspect when supported by at least two support members comprising a substantially upright rectangular sheet of cladding braced to resist out of plane deformation; footing means at the base of said upright sheet; perforated flange means at the upper edge of said upright sheet for connection with the edge flange of at least one of said elements by means of fastenings to dispose the cladding of said at least one element at an angle to said upright sheet; and substantially perpendicular edge flanges extending along the vertical edges of said upright sheet, said flanges having a plurality of holes therein to receive fastenings whereby one member is adapted for edge flange abutting connection to a like member.

Preferably, the perforated flange means comprises a rectangular sheet of cladding braced to resist out of plane deformation abutting said upper edge and disposed at an angle to said upright sheet; substantially perpendicular edge flanges extending along the free edges of said sheet; and holes in said flanges to receive fastenings.

DESCRIPTION OF THE PREFERRED EMBODIMENT

Figure 1:
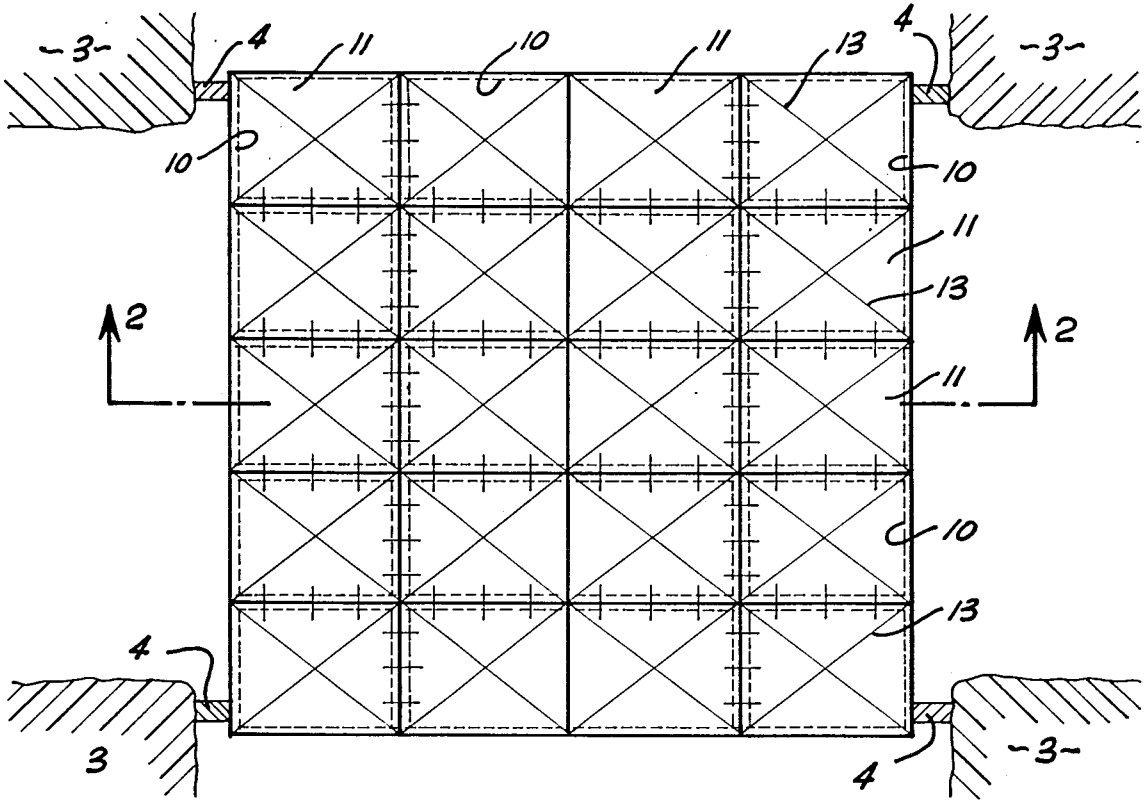
FIG. 1 is a plan view of an overcast according to the invention.
Figure 2:
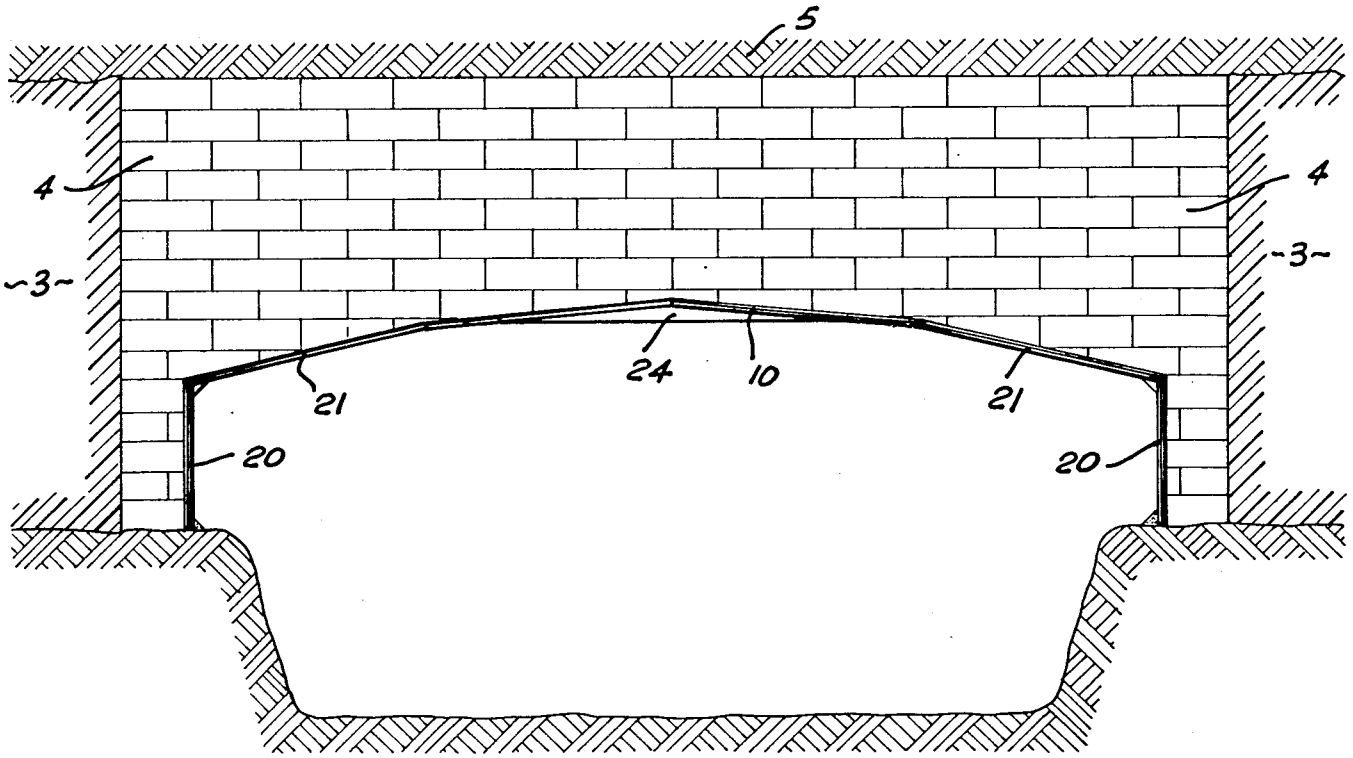
FIG. 2 is an elevation of an overcast according to the invention.
Figures 3, 4:
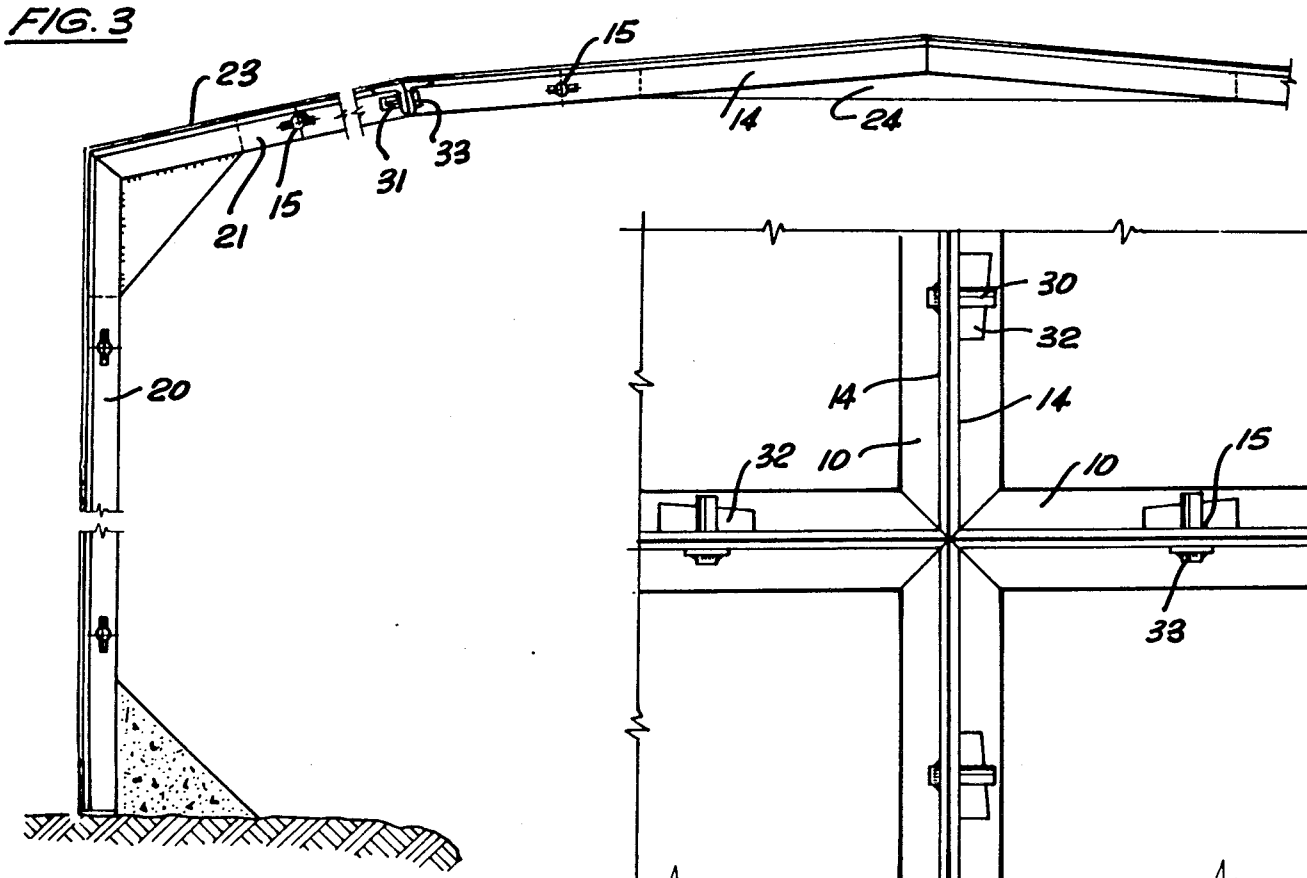
FIG. 3 is a part cross-section of the elevation shown in FIG. 2.
FIG. 4 shows in more detail a view of part of the overcast when viewed from beneath.
Figure 5:
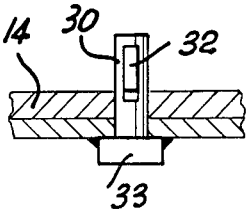
FIG. 5 is an enlarged view of part of the cross-section shown in FIG. 4.

With reference to FIG. 1 there is shown an intersection between a passageway 1 and a ventilation passage 2 defined between coal pillars 3. An overcast according to the invention is supporting a brick wall 4 blocking passageway 2 from the overcast to the roof 5 of the mine.

The overcast comprises a modular system in which there are two kinds of elements. The overcast comprises first elements which consist of rectangular frames 10 manufactured from welded angle iron and covered with 2 mm plate cladding 11 welded to the frame. These plates are stiffened by pressed bracing of the sheet to form crossed reinforcing braces, ribs, or creases 13. Flange 14 which extends perpendicularly from the sheet is perforated at intervals 15 to accept a pin connector hereinafter to be described, whereby a plurality of first elements may be connected in edge abutment.

A second element comprises two vertical frame members 20 each welded at an obtuse angle to an overhead frame member 21, the overhead members 21 being additionally supported by a gusset plate 22 welded across the obtuse angle. Both the vertical members 20 and overhead members 21 support plate cladding 23 which is also reinforced by a press-in cross-brace. In use the parts are connected as shown in the drawings with vertical members 20 disposed on opposite sides of a passageway and the span between overhead frame members 21 being bridged by the rectangular modular elements. The parts are interconnected by means of pins 30 which extend through corresponding holes 15 of the elements, pins 30 having on one side a head 33 which will not pass through the hole of the flange and having a slot 31 extending diametrically through the pin into which a wedge 32 can be hammered. If desired some pins 30 may be welded in place to act as guide pins assisting assembly. A generally triangular apex stiffener 24 is used to brace the joint between the rectangular modular elements forming the apex of the overcast. The stiffener 24 comprises a plate having a plurality of holes in its upper edges which facilitate connection of the plate 24 to the flanges of the modular elements by means of pins 30 as described for interconnection of the modular elements.

Figure 6:
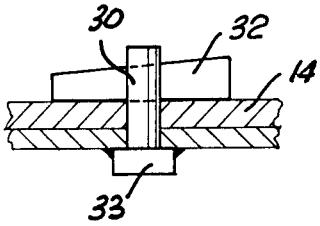
FIG. 6 is an inverted plan view of the part cross-section shown in FIG. 5.
Figure 7:
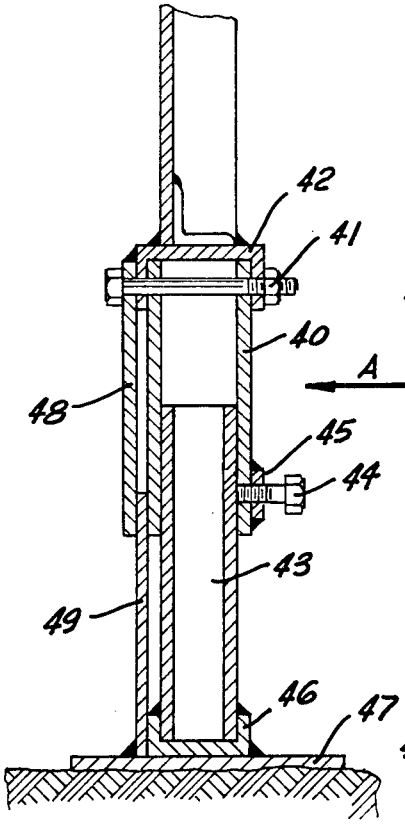
FIG. 7 is a part cross-section similar to FIG. 3 showing a modification of the present invention.
Figure 8:
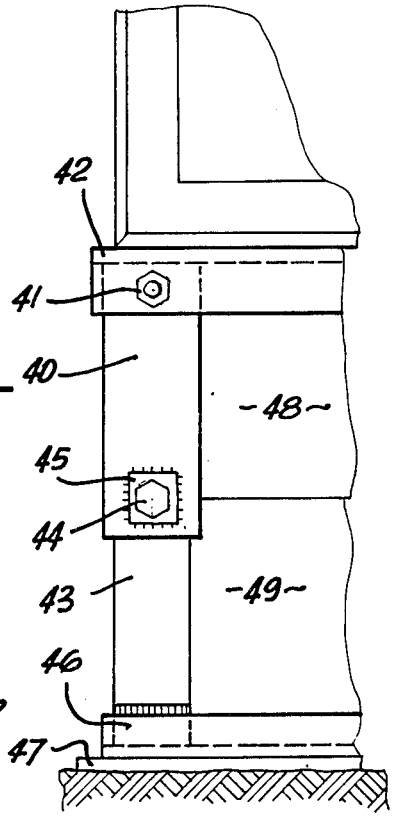
FIG. 8 is a view in the direction "A" of the modification shown in FIG. 7.

FIGS. 6 and 7 show a modification of the second element for use in mines where floor heave and/or roof pressure are expected. The modification comprises an adjustable pair of legs 40 pivotally connected by pins 41 to a head 42 attached to the bottom of vertical members 20. In the illustrated embodiment the legs 40 are hollow, tubular, of square cross-section, and telescopically adjustable in length by means of nested tubular extension members 43. The extension members 43 can be clamped at a desired length by means of a bolt 44 extending in threaded engagement through nuts 45 welded to legs 40 and piercing legs 40 to bear against the nested extension members 43. A substantially horizontal brace 46 is connected between the ends of extension members 43 and three securing plates 47 are welded to the underside of the brace 46. Legs 40 are joined by a cladding plate 48 which extends downwardly from the head 42 and overlaps a second cladding plate 49 joining extension members 43 and extending upwardly from the brace 46. The plates 48 and 49 slidingly overlap so as to allow adjustment of the length of the extension members 47 and provide continuous cladding between the brace 46 and head 42.

It will be apparent that in use the length of the extrension members 43 can be adjusted to allow for irregulations in the floor of the mine when constructing an overcast. Adjustment is affected by loosening bolts 44, sliding the extension members 43 to the desired length, and re-tightening bolts 44. The pins 41 allow the legs 40 to pivot with respect to head 42 so that extension members 43 can be extended to different lengths.

As descriged above, the bolts 44 bear against the nested extension members 43 to clamp them at a desired length and friction between the ends of the bolts 44 and the surface of the extension member 43 is sufficient to support the weight of the overcast. The forces generated by floor heave and roof pressure are, however, much larger and under these forces the extension members 43 can be forced into the legs 40 to reduce structural damage to the overcast.

As will be apparent to those skilled in the art from the teaching hereof the overcast may be extended in either direction by adding further modules. Because the overcast may be assembled without bolts it may be assembled rapidly. Each of the individual modules is of relatively light weight and readily transported into a mine. If desired the footings may be imbedded in concrete. For preference the cladding is treated to prevent corrosion and if desired joints may be sealed with an elastic material to keep out water. The construction is sufficiently strong not only to support brick work but also to support the weight of several men engaged in constructing a brick wall on the overcast.

I claim:

1. A mine overcast for ventilation control, said overcast comprising a plurality of edge abutting rectangular construction elements fastened together to form a span extending between support members at each side of the overcast;

said support members each comprising a flat rectangular sheet of cladding braced to resist out of plane deformation extending upwardly from footing means and joined along its upper edge to an upwardly and inwardly extending flat rectangular sheet of cladding braced to resist out of plane deformation, the free edges of said upwardly and inwardly extending sheet terminating in perforated edge flanges extending substantially perpendicular to said upwardly and inwardly extending sheet, and gusset means traversing the joint between said upwardly extending sheet and said upwardly and inwardly extending sheet to strengthen said joint;

said construction elements comprising a flat rectangular sheet of cladding braced to resist out of plane deformation, and perforated edge flanges extending substantially perpendicular to said sheet;

wherein said construction elements are fastened together in edge abutment to form said span by fastening means extending through aligned perforations in the edge flanges of adjacent elements, and wherein the construction elements forming each end of the span are joined to respective support members by fastening means extending through aligned perforations in the uppermost edge flanges of said support members and the adjacent edge flange of the construction elements.

2. A mine overcast as claimed in claim 1 wherein said footing means comprise two upright legs, one spaced apart from the other and each pivotally connected at its upper end to said support member; means whereby the length of each upright leg can be adjusted and then clamped and adapted to yield under excessive load to allow the length of each upright leg to reduce thereby avoiding damage to the overcast by floor heave; and a substantially horizontal brace connecting the lower end of one leg with the lower end of the other leg.

3. A mine overcast as claimed in claim 1 wherein at least one perforation in an edge flange is fitted with an outwardly extending locating pin adapted for insertion in a perforation in an edge flange of a like construction element or support member.

4. A mine overcast as claimed in claim 2 wherein said upright legs are telescopically adjustable.

5. A mine overcast as claimed in claim 4 wherein said upright legs can be clamped at an adjusted length by means of a lock bolt.

6. A mine overcast as claimed in claim 2 wherein at least two vertically overlapping sheets of cladding extend between said legs to clad the area between said member and said brace, said overlap adjusting with the length of said legs.

7. A mine overcast as claimed in claim 1 wherein said bracing to resist out of plane deformation comprises at least one diagonally extending rib.

8. A mine overcast as claimed in claim 7 wherein said at least one rib is formed by pressing of said cladding.

* * * * *